United States Patent [19]

Humphrey et al.

[11] Patent Number: 4,883,180

[45] Date of Patent: Nov. 28, 1989

[54] COLOR CODED MEDICINE CAPS AND LABELS FOR DAILY DOSAGE

[76] Inventors: Essie Mae Humphrey; Pete Humphrey, Jr., both of 19802 Dalfsen Ave., Carson, Calif. 90746

[21] Appl. No.: 204,584

[22] Filed: Jun. 9, 1988

[51] Int. Cl.[4] ..... B65D 83/04

[52] U.S. Cl. ..... 206/534

[58] Field of Search ..... 206/534

[56] References Cited

U.S. PATENT DOCUMENTS 3,826,222 7/1974 Romick ..... 206/534

4,473,156 9/1984 Martin ..... 206/534

*Primary Examiner*—John Rivell

*Attorney, Agent, or Firm*—Roger A. Marrs

[57] ABSTRACT

A coding system is disclosed herein for matching specific consumption times and for appropriate medicines stored in a medical container which includes an open-ended container having a removable cap closure and a label imprinted with the specific times for taking of the medicine. The cap and label are identically colored to represent the number of times that the medicine is to be taken per day. The label is further coded with a selected number of raised identification dots or nubs to represent the number of times that the medicine is to be taken per day. This small label is attached by the pharmacist in addition to the regular label per customer request.

1 Claim, 1 Drawing Sheet

COLOR CODED MEDICINE CAPS AND LABELS FOR DAILY DOSAGE

BACKGROUND OF THE INVENTION

1. Field of the Invention

The present invention relates to medicinal storage containers and, more particularly, to a novel container for holding a quantity of medicine which includes a cap and label of a selected color. Raised coded dots may be used for determining this information by sightless persons.

2. Brief Description of the Prior Art

In the past, it has been the conventional practice to store a quantity of medicine in the form of pills or tablets in a cylindrical container having a cap which removably closes the container. It is also customary to place a label on the exterior surface of the container that includes certain information specifying the number of tablets or capsules to be taken, as well as the number of times the dosage is taken during a daily period.

However, problems and difficulties have been encountered when employing medical or medicine containers previously described, which stem largely from the fact that handwritten or typed information on the label is not readily seen by sight-impaired persons, and even if read by the user, a certain amount of intellect is required to convert the handwriting or printed subject matter into usable information. For example, a mentally impaired person may not readily be able to read or understand times and daily dosage specifications which are indicated on a label.

Therefore, a long standing need has existed to provide a labelling system for holding a quantity of medical tablets, pills, capsules or the like which includes a coding means indicative of daily times and dosage to be taken. Such a means must be simple and complete so that mentally and sight-impaired persons can readily remove the proper dosage at the proper time.

SUMMARY OF THE INVENTION

Accordingly, the above problems and difficulties are obviated by the present invention which provides a novel coding system for use with medicine containers that matches specific consumption times and dosage amounts which is discernible by mentally or sight-impaired persons. In one form of the invention, the coding system includes a combination of container cap and label of identical color that is selected from a plurality of colors indicative of the number of times the dosage is to be taken during the day. The cap and label may be colored red while colored blue for a different number. Furthermore, the label is provided with additional coding means, having a selected number of raised identification dots or nubs which are indicative of the daily dosage requirements.

Therefore, it is among the primary objects of the present invention to provide a novel coding system for containers holding medicine whereby the user is reminded to take the appropriate medicine and dosage at the right time during a 24-hour period.

Another object of the present invention is to provide a novel color coding and raised nub coding system for medicine containers, which is particularly beneficial to elderly people, the illiterate and those with sight impairment who are obligated to take several prescribed medications on a daily basis.

Another object of the present invention is to provide an inexpensive and simple means for indicating to a user of prescribed medications the proper daily dosage to be taken.

Yet another object of the present invention is to provide a simple system assisting individuals in gaining the most benefit from prescription medications when such persons are mentally or sight-impaired, and which includes both a visual and physical code indicative of medicine daily dosage.

Still another object of the present invention is to provide a novel medical dispensing system including coding means which prevents accidental ingestion of the wrong medication and which is ideally suited for the elderly, the illiterate and those taking many prescribed medications.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
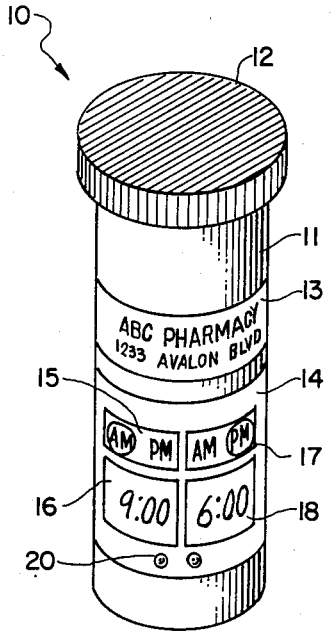
FIG. 1 is a front perspective view of a container holding a quantity of prescribed medication and which includes coding means in accordance with the present invention for indicating daily dosage.

Referring to FIG. 1, numeral 1 indicates a container for storing prescribed medications incorporating the novel coding system of the present invention, which includes a cylindrical container 11 having a cap 12 closing one end of the container so that the medication is securely stored therein. The cap 12 may be placed on the end of the cylindrical container by any suitable means which may take the form of a snap-lock engagement, a threaded engagement, or may take the form of a socket closure. As is usual, the external surface of the container 11 includes an identifying notation 13 which usually carries the name of the pharmacy and address of the dispensing authority. Immediately below the identification 13, there is a label 14 which carries the times for taking the dosage of medication within the container during a 24-hour time period. For example, a block or area 15 indicates AM or PM which, when circled, indicates morning or afternoon dosage. Immediately beneath this area is a second area, identified by numeral 16, which displays a time factor taken in combination with the morning or afternoon indication in area 15. For example, the indication of 9 o'clock in area 16 and the circling of AM in area 15 indicates that the person should take the dosage at 9 o'clock in the morning. For additional dosages such as for twice a day, a second morning and afternoon block or area 17 is provided along with a second time block or area 18.

It is to be particularly noted that label 14 includes raised nubs or dots, such as dot 20. The dots may be felt by the fingers of the user and are a part of the coding system indicating the number of times the medicine should be taken daily.

Figure 2:
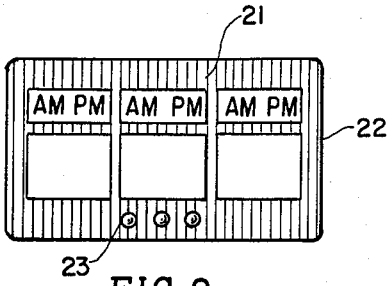
FIG. 2 is a front plan view of a label which may be used to indicate a different dosage from the dosage indicated on the label used in FIG. 1.
Figure 3:
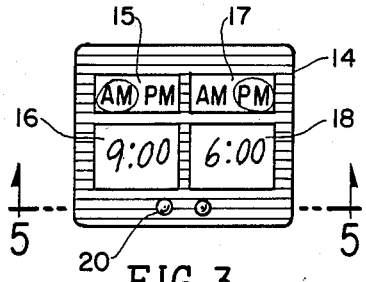
FIG. 3 is a view of the label used on the container shown in FIG. 1.
Figure 4:
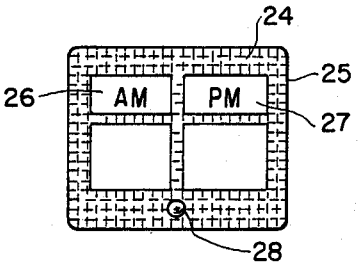
FIG. 4 is a front plan view of still another version of a label showing a different code for daily dosage in accordance with the present invention.

Referring now in detail to FIGS. 2, 3 and 4, it can be seen that different color codings can be used for the cap and label combination. For example, in FIG. 2, the color blue is indicatd by numeral 21 on the label 22 and the cap would be colored blue to match. It is also to be noted that the label 22 includes three areas for morning and afternoon/night indications or areas and three time areas. Therefore, the label 22 would be used in instances where the user is to partake of medicine three times a day. Included in the coding combination are the raised dots or nubs of which numeral 23 illustrates one in a series of three so that persons may use a touch system for indicating that this medicine should be taken three times during the day. This will indicate to the user that other prescribed medications may have one or two raised nubs and, therefore, no confusion would exist between the user in determining what medicine to take from what container.

Referring to FIG. 4, still another color coding is illustrated which may take the form of a yellow color, indicated by numeral 24 on a label 25. In this instance, the AM and PM areas are represented by numerals 26 and 27 as separate and spaced-apart areas as opposed to the space or area 15 on label 14 where the AM/PM appears on the same space or area. Also, it can be seen that only one raised dot 28 is illustrated. The yellow coloring 24 of the label will match with a yellow coloring on the cap 12.

Figure 5:
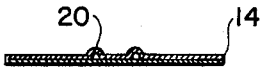
FIG. 5 is a transverse cross-sectional view of the label shown in FIG. 3 indicating the coding means taking the form of raised dots or nubs.

Referring now in detail to FIGS. 3 and 5, it can be seen that the label 14 includes a raised nub 20 that may be easily touched and felt by the fingers of the user. In the present instance, a pair of nubs is illustrated; however, it is to be understood that one or more nubs are all that is needed to code information into the label which would be available to the user by feel.

Therefore, it can be seen that the novel coding system, when used in combination with a storage container for medicines, will be an aid to users in taking appropriate medicine and dosages at the right time. The labels will be attached at a pharmacy and the labels denote how many times a day the prescription should be taken. The denoting of this information is by color coding between matched caps and labels, as well as by the number of raised dots or nubs on the label itself. The coding system of the present invention may be particularly beneficial to elderly people, the illiterate and those who take several prescribed medications on a daily basis.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A coded medicine container holding a quantity of medicine to be taken at specific time periods, the combination which comprises:

an open-ended container having an exterior surface carrying a first color;

a cap closure having an exterior surface removably carried on said container to selectively close the open end thereof;

said container having a label carried on said exterior surface imprinted with indicia related to time periods for taking of the medicine;

said cap closure and said label being identical in color to visually represent said indicia related to the number of times that medicine is to be taken per day;

said container color being different from said cap closure and said label color;

a plurality of raised, non-removable nubs carried on said label correlating with and cooperating with said cap closure and said label color to be indicative of the medication time period of consumption; and said cap closure and said label color representation and said raised nubs constitute a code correlated to represent said indicia related to medicine-taking times.

* * * * *